US009099023B2

(12) United States Patent
Baek et al.

(10) Patent No.: US 9,099,023 B2
(45) Date of Patent: Aug. 4, 2015

(54) DISPLAY DRIVER CIRCUIT, OPERATING METHOD THEREOF, AND USER DEVICE INCLUDING THE SAME

(75) Inventors: Dong-Hoon Baek, Seoul (KR); JaeYoul Lee, Hwaseong-si (KR)

(73) Assignee: SAMSUNG ELECTRONICS CO., LTD., Suwon-si, Gyeonggi-do (KR)

( * ) Notice: Subject to any disclaimer, the term of this patent is extended or adjusted under 35 U.S.C. 154(b) by 0 days.

(21) Appl. No.: 13/313,579

(22) Filed: Dec. 7, 2011

(65) Prior Publication Data

US 2012/0146965 A1 Jun. 14, 2012

(30) Foreign Application Priority Data

Dec. 13, 2010 (KR) ..... 10-2010-0127154

(51) Int. Cl.

| | |
|---|---|
| ***G09G 5/00*** | (2006.01) |
| ***G09G 3/00*** | (2006.01) |
| *G09G 3/36* | (2006.01) |

(52) U.S. Cl.

CPC ..... *G09G 3/006* (2013.01); *G09G 3/3688* (2013.01); *G09G 3/3666* (2013.01)

(58) Field of Classification Search

USPC ..... 345/596, 204, 690, 63, 55, 89, 101, 88; 348/792; 359/292

See application file for complete search history.

(56) References Cited

U.S. PATENT DOCUMENTS

| | | | | |
|---|---|---|---|---|
| 5,341,399 | A | 8/1994 | Eguchi | |
| 5,726,991 | A | 3/1998 | Chen et al. | |
| 7,567,092 | B2 * | 7/2009 | Park et al. | 324/760.01 |
| 2005/0071399 | A1 | 3/2005 | Bonaccio et al. | |
| 2006/0143549 | A1 | 6/2006 | Yasumoto et al. | |
| 2007/0236243 | A1 * | 10/2007 | Park et al. | 324/770 |
| 2010/0077211 | A1 * | 3/2010 | Lee | 713/168 |
| 2011/0050705 | A1 | 3/2011 | Wada et al. | |

FOREIGN PATENT DOCUMENTS

| | | | |
|---|---|---|---|
| CN | 101454681 | | 6/2009 |
| JP | 2004-126435 | A | 4/2004 |
| KR | 10-2003-0057138 | A | 7/2003 |
| KR | 10-2006-0037754 | A | 5/2006 |

OTHER PUBLICATIONS

Mita et al., A novel pseudo random bit generator for cryptographic applications, 2002, 9th International Conference on Electronics, Circuits and Systems, 2002. vol. 2, pp. 489-492.*

* cited by examiner

*Primary Examiner* — Jonathan Horner
*Assistant Examiner* — Douglas M Wilson
(74) *Attorney, Agent, or Firm* — Lee & Morse, P.C.

(57) ABSTRACT

A display driver circuit, including a source driver configured to drive source lines of a display panel, and a timing controller configured to transfer image data to the source driver and to control the source driver such that the transferred image data is displayed via the display panel, the timing controller also being configured to transfer to the source driver a control signal and a test pattern, which are used to test a bit error rate, and the source driver being configured to test the bit error rate of the transferred test pattern in response to the transferred control signal.

12 Claims, 7 Drawing Sheets

DISPLAY DRIVER CIRCUIT, OPERATING METHOD THEREOF, AND USER DEVICE INCLUDING THE SAME

BACKGROUND

1. Field

Example embodiments relate to a display driver circuit, an operating method thereof, and a user device including the same.

2. Description of the Related Art

For a light and low-powered user device, a flat panel display device such as a liquid crystal display (LCD) may be used instead of a cathode-ray tube (CRT). The flat panel display device may include a display panel for displaying an image, and the display panel may be formed of a plurality of pixels. The pixels may be formed at intersections of a plurality of gate lines (used to select gates of pixels) and a plurality of source lines (used to transfer color data such as gray-scale data).

An image may be displayed on the display panel by applying a control signal to a gate line and supplying color data to a source line. A display driver integrated (DDI) circuit may supply the control signal and the color data to the display panel. Thus, the DDI circuit may receive image data from a central processing unit of a system, and may convert the input image data into the control signal and the color data.

SUMMARY

An embodiment is directed to a display driver circuit, including a source driver configured to drive source lines of a display panel, and a timing controller configured to transfer image data to the source driver and to control the source driver such that the transferred image data is displayed via the display panel, the timing controller also being configured to transfer to the source driver a control signal and a test pattern, which are used to test a bit error rate, and the source driver being configured to test the bit error rate of the transferred test pattern in response to the transferred control signal.

The timing controller may include a scrambler configured to randomize data, the scrambler randomizing the image data.

The scrambler may be configured to randomize the test pattern.

The timing controller may include a pattern generator configured to generate the test pattern.

The source driver may include a de-scrambler configured to de-randomize the transferred image data.

The de-scrambler may be configured to de-randomize the transferred test pattern.

The source driver may include an error counter configured to detect a number of erroneous bits of the test pattern.

The source driver may be configured to output a bit error rate test result via the display panel.

The source driver may be configured to output a bit error rate test result via a data port.

The display driver circuit may further include a gate driver configured to drive gate lines of the display panel.

Another embodiment is directed to an operating method of a display driver circuit that includes a source driver for driving source lines of a display panel, and a timing controller for controlling the source driver, the operating method including transferring a control signal for testing a bit error rate of data transferred between the timing controller and the source driver, transferring a test pattern for testing the bit error rate, and testing a bit error rate of the transferred test pattern in response to the control signal.

Transferring the control signal, transferring the test pattern, and testing the bit error rate may be performed when the source driver and the timing controller operate in a bit error rate test mode.

The operating method may further include transferring image data and displaying the transferred image data via the display panel. Transferring the image data and displaying the transferred image data may be performed when the source driver and the timing controller operate in a normal mode.

The operating method may further include randomizing the test pattern before the test pattern is transferred.

The operating method may further include de-randomizing the randomized test pattern before the bit error rate is tested.

The operating method may further include outputting a bit error rate test result.

The bit error rate test result may be output via the display panel.

The bit error rate test result may be output outside the display driver circuit via a data port.

The bit error rate test result may be an accumulated result of number of erroneous bits detected when a bit error rate of the transferred test pattern is tested.

Another embodiment is directed to a user device, including a display panel, a display driver circuit configured to drive the display panel, the display driver circuit including a source driver configured to drive source lines of a display panel, and a timing controller configured to transfer image data to the source driver and to control the source driver such that the transferred image data is displayed via the display panel, the timing controller also being configured to transfer to the source driver, in response to a control of a central processing unit, a control signal and a test pattern, which are used to test a bit error rate, and the source driver being configured to test the bit error rate of the transferred test pattern in response to the transferred control signal, and a central processing unit configured to control the display driver circuit such that an image is displayed via the display panel.

Another embodiment is directed to a display device, including a display panel including a plurality of pixels, source and gate lines coupled to the pixels, a display driver including a timing controller and a source driver that has an error counter, the display driver being coupled to the source and gate lines, the display driver being configured to perform a bit error rate test, wherein, during the bit error rate test, the timing controller is configured to generate a test pattern and transfer the test pattern to the source driver, and the error counter is configured to count erroneous bits in the test pattern received by the source driver.

The display driver may include a plurality of source drivers, each source driver receiving a corresponding test pattern from the timing controller.

Each source driver may count erroneous bits of the corresponding test pattern.

Each source driver may count erroneous bits corresponding to a unique subset of columns of the display panel.

BRIEF DESCRIPTION OF THE DRAWINGS

The above and other features and advantages will become more apparent to those of ordinary skill in the art by describing in detail example embodiments with reference to the attached drawings, in which.

DETAILED DESCRIPTION

Figure 1:
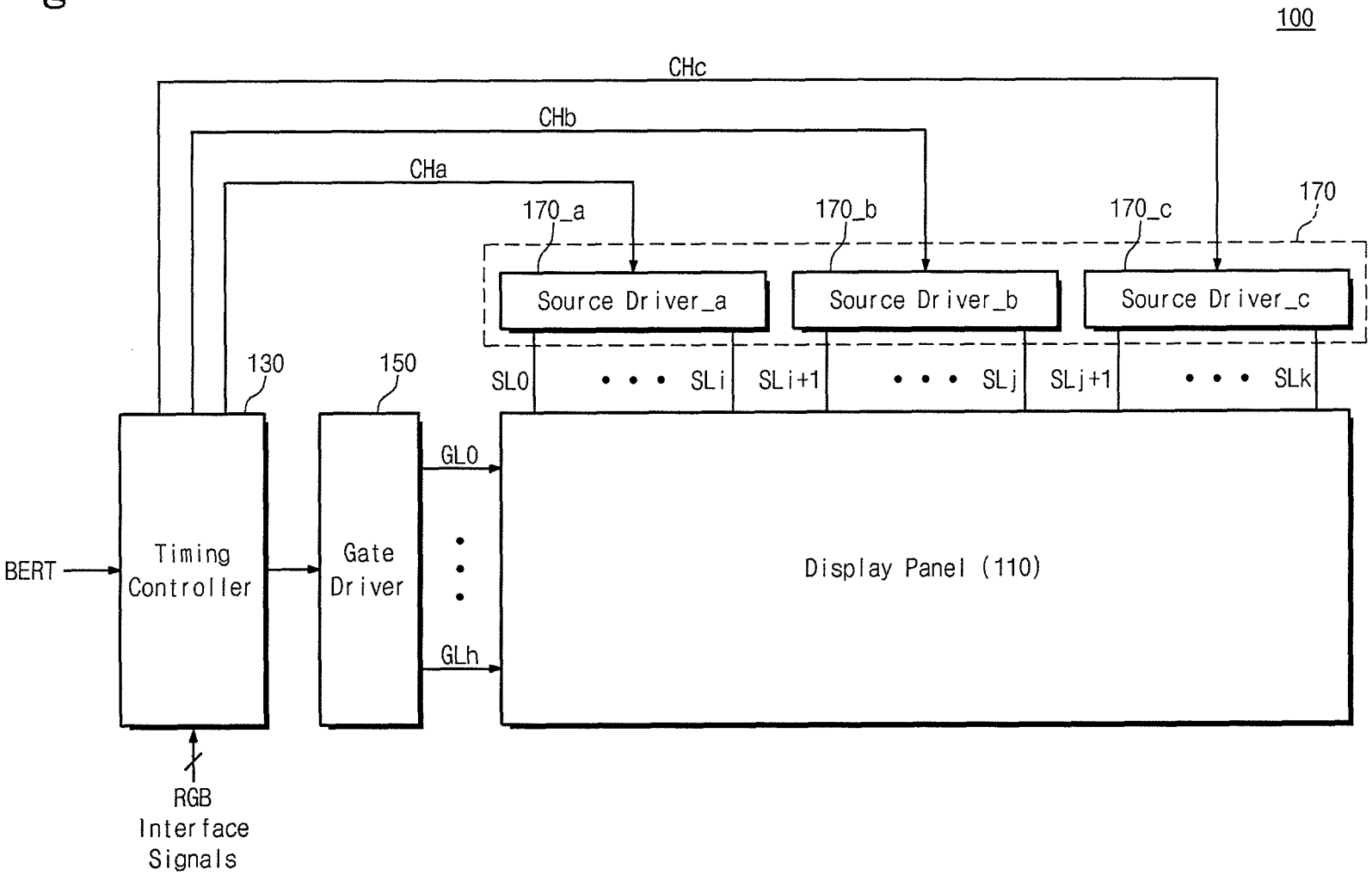
FIG. 1 illustrates a block diagram of a flat panel display device according to an example embodiment.

Korean Patent Application No. 10-2010-0127154, filed on Dec. 13, 2010, in the Korean Intellectual Property Office, and entitled: "Display Driver Circuit, Operating Method Thereof, And User Device Including That," is incorporated by reference herein in its entirety.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the invention to those skilled in the art. In the drawing figures, the dimensions of layers and regions may be exaggerated for clarity of illustration. Like reference numerals refer to like elements throughout.

It will be understood that, although the terms first, second, third, etc., may be used herein to describe various elements, components, regions, layers, and/or sections, these elements, components, regions, layers, and/or sections should not be limited by these terms. These terms are only used to distinguish one element, component, region, layer, or section from another element, component, region, layer, or section. Thus, a first element, component, region, layer, or section discussed below could be termed a second element, component, region, layer, or section without departing from the teachings of the inventive concept.

Spatially relative terms, such as "beneath," "below," "lower," "under," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below," "beneath," or "under" other elements or features would then be oriented "above" the other elements or features. Thus, the example terms "below" and "under" can encompass both an orientation of above and below. The device may be otherwise oriented (rotated 90 degrees or at other orientations) and the spatially relative descriptors used herein interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the inventive concept. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

It will be understood that when an element or layer is referred to as being "on," "connected to," "coupled to," or "adjacent to" another element or layer, it can be directly on, connected, coupled, or adjacent to the other element or layer, or intervening elements or layers may be present. In contrast, when an element is referred to as being "directly on," "directly connected to," "directly coupled to," or "immediately adjacent to" another element or layer, there are no intervening elements or layers present.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein.

FIG. 1 illustrates a block diagram of a flat panel display device according to an example embodiment. Referring to FIG. 1, a flat panel display device 100 may include a display panel 110, a timing controller 130, a gate driver 150, and a source driver 170.

The timing controller 130, the gate driver 150, and the source driver 170 may constitute a display driver circuit. The display driver circuit may further include a memory controller, a memory device, etc. The display driver circuit may convert image data provided from a CPU of a system into a control signal and color data to provide them to the display panel 110. The system may be a user device which is configured to display an image via the display panel 110.

The display panel 110 may include a plurality of pixels (not shown) displaying an image. The pixels may be formed at intersections of gate lines GL0 to GLh and source lines SL0~SLi, SLi+1~SLj, and SLj+1~SLk, respectively. Each of the pixels may include a switching element (not shown) connected with a gate line and a source line, a liquid crystal capacitor (not shown) connected with the switching element, and a storage capacitor (not shown). The pixels will be more fully described with reference to FIG. 2, below.

The timing controller 130 may receive a bit error rate (BER) test control signal BERT from the CPU of the system. The timing controller 130 may operate at a test mode for testing a bit error rate in response to activation of the bit error rate test control signal BERT. The timing controller 130 may operate in a normal mode in response to inactivation of the bit error rate test control signal BERT.

The timing controller 130 may receive RGB interface signals (hereinafter, referred to as 'RGB I/F signals') from the CPU of the system. The RGB I/F signals may include control signals and image signals. For example, the control signals included in the RGB I/F signals may include a vertical sync signal VSYNC, a horizontal sync signal HSYNC, and a data enable signal DE. The timing controller 130 may provide blocks (e.g., the gate driver 150 and the source driver 170) with control signals for driving the display panel based upon the input control signals. Thus, the timing controller 130 may control an overall operation of the display driver circuit 100.

Herein, the vertical sync signal VSYNC included in the RGB I/F signals may indicate a time taken to display one frame on the display panel 110. The horizontal sync signal HSYNC may indicate a time taken to drive pixels connected with one of the gate lines GL0 to GLh. Accordingly, the horizontal sync signal HSYNC may be formed of pulses corresponding to pixels connected with one gate line, respectively. The data enable signal DE may indicate a time taken to provide image data to pixels of the display panel 110.

Image signals included in the RGB I/F signals may include color data to be displayed via pixels of the display panel 110. The image signals may be stored in a memory device (not shown) according to the control of the timing controller 130, and then may be provided to the source driver 170.

The gate driver 150 may drive the gate lines GL0 to GLh under the control of the timing controller 130. For example, in response to a control signal provided from the timing controller 130, the gate driver 150 may control the gate lines GL0 to GLh so as to be activated sequentially. The source driver 170 may drive lines SL0 to SLk under the control of the timing controller 130. For example, in response to a control signal provided from the timing controller 130, the source driver 170 may drive the source lines SL0 to SLk with image data provided from the memory device (not shown).

In the event that a size of the display panel 110 is large, the source driver 170 may be formed of a plurality of source drivers 170_*a*, 170_*b*, and 170_*c*. The source lines SL0 to SLk may be driven by the source drivers 170_*a*, 170_*b*, and 170_*c*. For example, the source lines SL0 to SLi may be driven by the source driver 170_*a*, the source lines SLi+1 to SLj by the source driver 170_*b*, and the source lines SLj+1 to SLk by the source driver 170_*c*, respectively.

A control signal and color data may be provided to the source drivers 170_*a*, 170_*b*, and 170_*c* via channels CHa, CHb, and CHc from the timing controller 130. Lengths of the channels CHa, CHb, and CHc may differentiate according to a size of the display panel 110. Thus, the larger the display panel, the longer the channel lengths. As channel lengths become longer, the control signal and color data provided to the source drivers 170_*a*, 170_*b*, and 170_*c* may become more erroneous due to signal delay or electromagnetic interference (EMI).

The display driver circuit according to an example embodiment may be configured to make a bit error rate (BER) test independently. Thus, the timing controller 130 and the source driver 170 may judge whether data transferred via a channel is normally transferred within an allowable limit of error. The display driver circuit may be configured to display a BER test result, e.g., using the display panel 110. In another implementation, the BER test result may be stored in the source driver 170 and then may be output to an external device as occasion demands.

The display driver circuit may be configured to perform a BER test operation. Thus, a test device, and a test circumstance for testing a bit error rate may not be needed. Accordingly, it may be possible to reduce a cost needed and a time taken to make the BER test.

Figure 2:
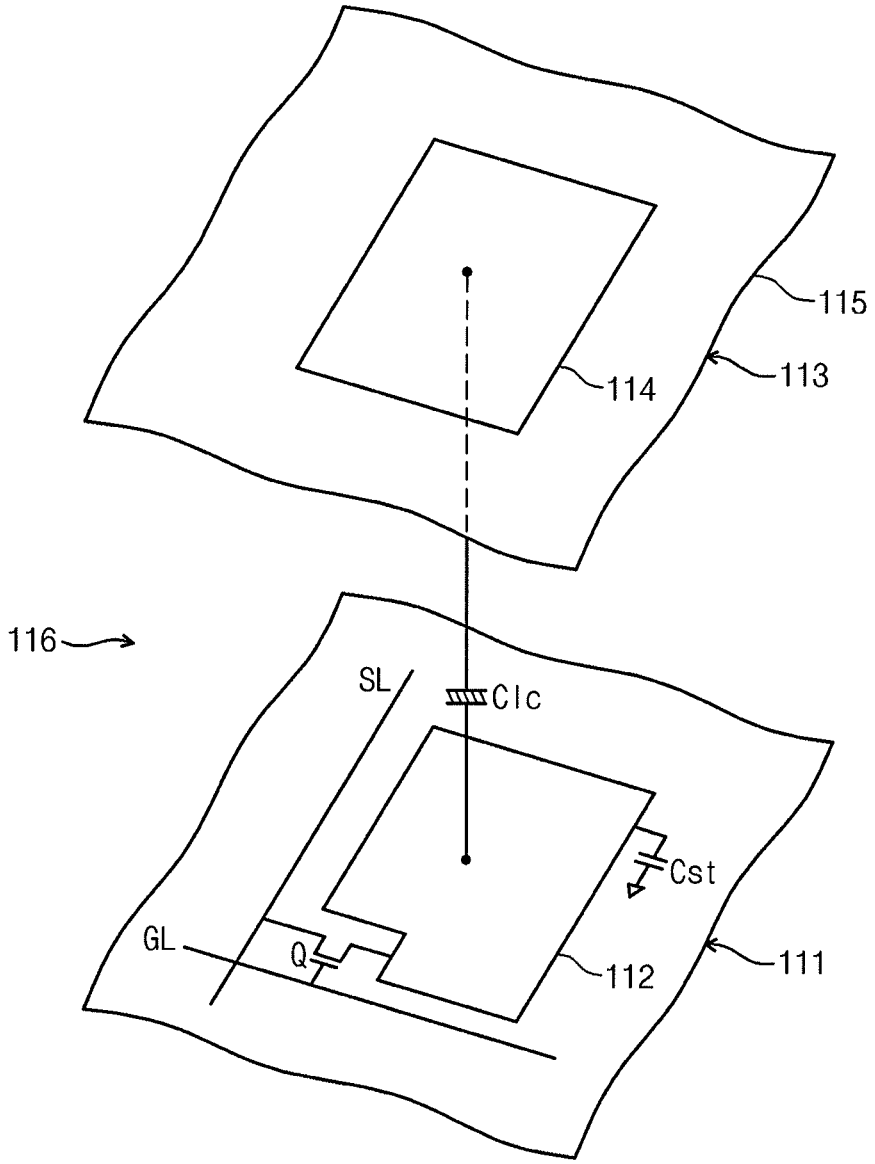
FIG. 2 illustrates an equivalent circuit diagram of a pixel of a display panel in FIG. 1.

FIG. 2 illustrates an equivalent circuit diagram of a pixel of a display panel in FIG. 1. Referring to FIG. 2, a display panel may include a lower display plate 111, an upper display plate 113, and a liquid crystal layer 116 interposed between the lower display plate 111 and the upper display plate 113. The lower display plate 111 may be disposed to be opposite to the upper display plate 113.

Each pixel may include a switching element Q connected with a gate line GL and a source line SL, a liquid crystal capacitor Clc connected with the switching element Q, and a storage capacitor Cst. In another implementation, the storage capacitor Cst may be omitted.

The switching element Q may be, e.g., a tri-terminal element such as a thin film transistor provided at the lower display plate 111. A control terminal of the switching element Q may be connected with the gate line GL transferring a gate signal (or, a scan signal), an input terminal thereof may be connected with the source line SL, and an output terminal thereof may be connected with the liquid crystal capacitor Clc and the storage capacitor Cst.

The liquid crystal capacitor Clc may have a pixel electrode 112 of the lower display plate 111 and a common electrode 115 of the upper display plate 113 as its two terminals. The liquid crystal layer 116 may function as a dielectric material between the electrodes 112 and 115. The pixel electrode 112 may be connected with the switching element Q. The common electrode 115 may be formed on an entire surface of the upper display plate 113 and may be supplied with a common voltage. The storage capacitor Cst (serving an auxiliary role of the liquid crystal capacitor Clc) may be formed by overlapping a signal line (not shown) provided at the lower display plate 111 and the pixel electrode 112, with an insulating material interposed between the lower display plate 111 and the pixel electrode 112. The signal line may be biased by a voltage such as the common voltage.

The display panel 110 may display colors in a space division manner, a time division manner, etc. With the space division manner, each pixel may distinctly display one of primary colors. With the time division manner, each pixel may display primary colors in turn. Thus, each pixel may display a required color by a spatial or temporal sum of primary colors, e.g., a red, a green, and a blue.

In the example pixel in FIG. 2, space division may be used. There is exemplarily shown the case that a color filter 114 indicating one of the primary colors is formed at an area of the upper display plate 113 corresponding to the pixel electrode 112. In other examples (not shown), the color filter 114 may be formed over or below the pixel electrode 112 of the lower display plate 111. At least one polarizer may be attached on an outer surface of the display panel 110 to polarize a light.

Figure 3:
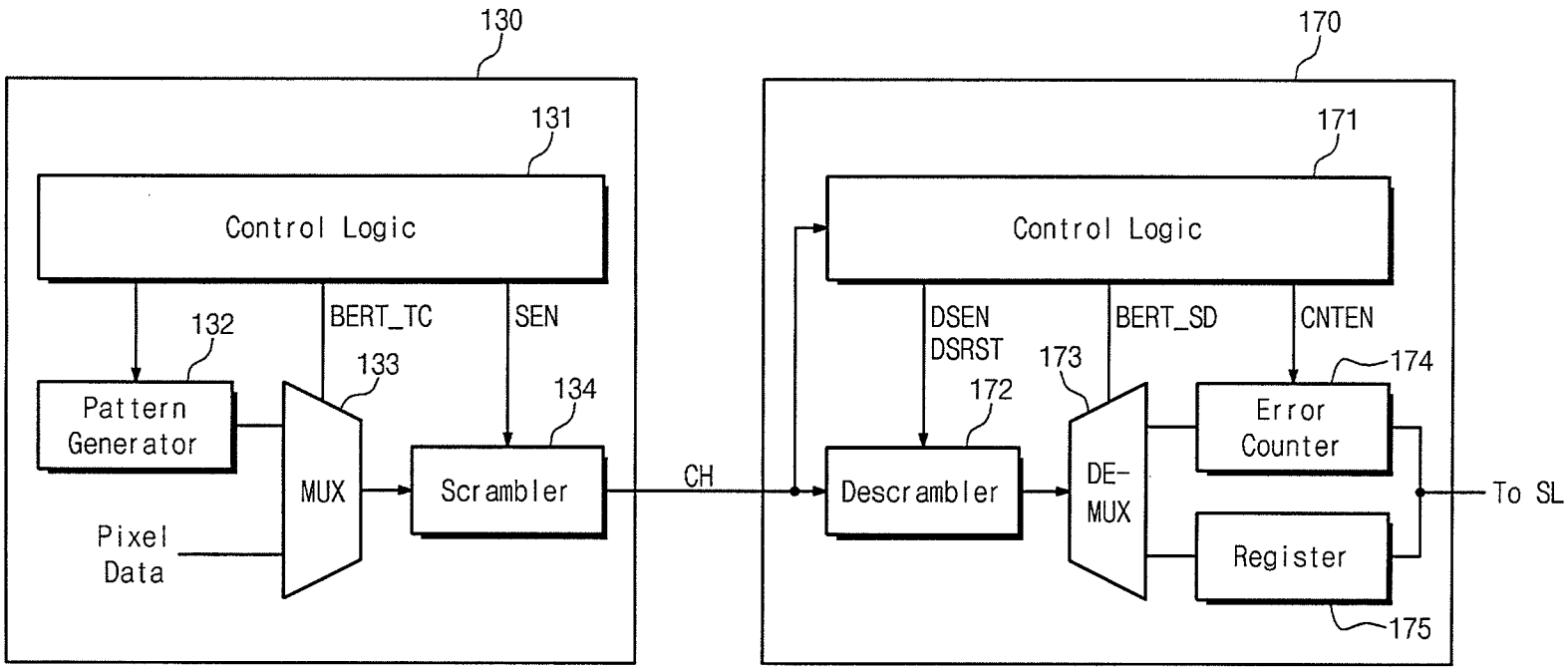
FIG. 3 illustrates a block diagram of a timing controller and a source driver in a display driver circuit according to an example embodiment.

FIG. 3 illustrates a block diagram of the timing controller 130 and the source driver 170 in the display driver circuit 110 according to an example embodiment. Referring to FIG. 3, the timing controller 130 may include control logic 131, a pattern generator 132, a multiplexer (MUX) 133, and a scrambler 134. The source driver 170 may include control logic 171, a de-scrambler 172, a de-multiplexer (DEMUX) 173, an error counter 174, and a register 175.

Generally, a digital signal transferred via a channel CH may be affected by the EMI according to a data pattern. However, according to the present embodiment, data transferred via the channel CH may be randomized (or, scrambled) so as not to be affected by the EMI. Thus, the timing controller 130 may randomize data to be provided to the source driver 170 via the scrambler 134, and may transfer the randomized data to the source driver 170. The source driver 170 may de-randomize the input data via the de-scrambler 172.

According to an example embodiment, the timing controller 130 and the source driver 170 may operate in a normal mode and a bit error rate (BER) test mode. In the normal mode, the timing controller 130 and the source driver 170 may transmit and receive a control signal and color data for driving a display panel 110 in FIG. 1. In the BER test mode, the timing controller 130 and the source driver 170 may transmit and receive a control signal and test pattern for testing a bit error rate.

An operation of the timing controller 130 and the source driver 170 in the normal mode will be more fully described, below.

The control logic 131 of the timing controller 130 may control the multiplexer 133 such that pixel data is provided to the scrambler 134. The pixel data may include color data for driving the display panel 110. The scrambler 134 may randomize the pixel data under the control of the control logic 131. The randomized pixel data may be sent to the source driver 170 via the channel CH.

The de-scrambler 172 of the source driver 170 may de-randomize transferred data under the control of the control logic 171. The control logic 171 of the source driver 170 may control the de-multiplexer 173 such that the de-randomized pixel data is provided to the register 175. Pixel data temporarily stored in the register 175 may be provided to respective source lines under the control of the control logic 171.

An operation of the timing controller 130 and the source driver 170 in the BER mode will be more fully described, below.

The control logic 131 of the timing controller 130 may control the pattern generator 132 so as to generate a test pattern for testing the bit error rate. The generated test pattern may be provided to the scrambler 134 via the multiplexer 133. At this time, the control logic 131 may generate a multiplexer control signal BERT_TC such that the generated test pattern is provided to the scrambler 134. The scrambler 134 may randomize the test pattern under the control of the control logic 131. The randomized test pattern may be sent to the source driver 170 via the channel CH under the control of the control logic 131.

With the above-described operation of the timing controller 130, a pseudo random binary sequence (PRBS) test pattern may be transferred to the source driver 170. Ideally, it is desirable to measure an error using real data in order to judge whether an error is generated from data transferred from the timing controller 130 to the source driver 170. However, since it may not be efficient to measure an error in such a manner, the PRBS test pattern may be used.

If a test pattern for BER test is sent to the source driver 170, the source driver 170 may analyze the input test pattern to judge whether an error is generated from the transferred data. The control logic 171 of the source driver 170 may judge whether the transferred data is data for the BER test, and may control constituent blocks of the source driver 170. This will be more fully described with reference to FIG. 4.

The de-scrambler 172 of the source driver 170 may de-randomize the transferred data under the control of the control logic 171. The de-randomized data may be identical to a test pattern generated from the pattern generator 132. The de-randomized test pattern may be provided to the error counter 174 via the de-multiplexer 173. At this time, the control logic 171 may generate a de-multiplexer control signal BERT_SD such that the de-randomized test pattern is provided to the error counter 174.

The error counter 174 may judge whether the transferred test pattern is erroneous, under the control of the control logic 171. For example, in the event that all data values of the transferred test pattern are expected to be data '0', the error counter 174 may count the number of data '1'. An erroneous bit number counted by the error counter 174 may be output to an external device or to a display panel 110 as a BER test result. This will be more fully described with reference to FIG. 6.

A display driver circuit according to an example embodiment may be configured to make a BER test independently. Thus, the timing controller 130 and the source driver 170 may perform a BER test operation for judging whether data transferred via a channel is transferred normally within a given error range. Since the BER test may be made independently by the display driver circuit, a test device and a test circumstance for testing a bit error rate may not be required. Accordingly, it may be possible to reduce a cost and a time which are used to perform the BER test operation.

Figure 4:
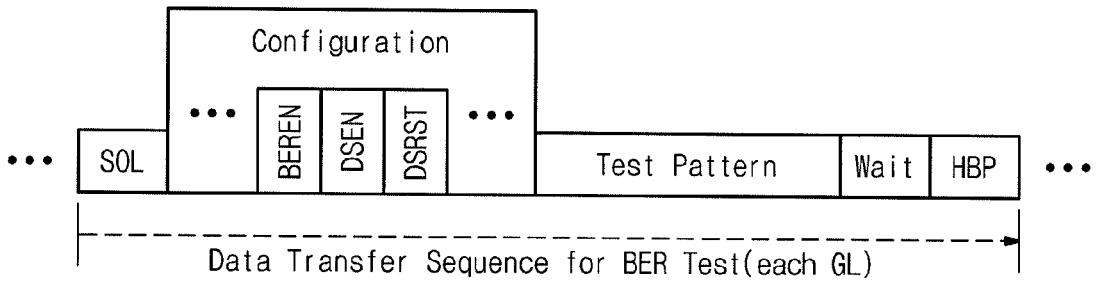
FIG. 4 illustrates a diagram of a flow of data transferred at execution of bit error rate test according to an example embodiment.

FIG. 4 illustrates a diagram of a flow of data transferred at execution of a bit error rate test according to an example embodiment. In FIG. 4, there is exemplarily illustrated the case that bit error rate (BER) test patterns are transferred by the number of pixels connected with one gate line GL. For example, data transferred from a timing controller 130 in FIG. 1 to a source driver 170 in FIG. 1 may have a size corresponding to the number of pixels connected with one gate line GL. Accordingly, data transferred during the BER test may have the same size as data transferred in a normal mode.

When the timing controller 130 and the source driver 170 operate in the BER test mode, data transferred from the timing controller 130 to the source driver 170 may be divided into a control signal and a test pattern. The control signal may include a start of line signal SOL indicating data corresponding to one gate line, configuration signals, and wait signals Wait and HBP indicating a transfer wait time. The control signal may be provided to the control logic 171 of the source driver 170.

As the start of line signal SOL is sent to the source driver 170 from the timing controller 130, data transfer may be made to perform the BER test operation. Afterward, the configuration signals, including a signal for configuring the BER test, may be sent.

In an example embodiment, the signal for configuring the BER test may include a BER test start signal BEREN, a de-scrambler signal DSEN, and a de-scrambler reset signal DSRST. In response to the BER test start signal BEREN, the control logic 171 of the source driver 170 (refer to FIG. 3) may control constituent blocks to perform the BER test. Until an inactivated BER test start signal BEREN is transferred, the control logic 171 may control the constituent blocks to perform the BER test.

If an activated BER test start signal BEREN is received, the control logic 171 of the source driver 170 may activate a de-scrambler 172. If an activated de-scrambler reset signal DSRST is received, the control logic 171 of the source driver 170 may reset the de-scrambler 172.

If a configuration for executing the BER test is completed according to configuration signals, a test pattern may be transferred. After the test pattern is sent, wait signals Wait and HBP may be transferred. When the timing controller 130 and the source driver 170 operate in the normal mode, the wait signals Wait and HBP may be a signal informing a dummy time for driving a display panel 110 in FIG. 1.

According to an example embodiment, signals BEREN, DSEN, and DSRST for configuring the BER test may be included in a configuration signal and may be transferred to the source driver 170 from the timing controller 130. In another implementation, the signals BEREN, DSEN, and DSRST for configuring the BER test may be transferred via separately assigned signal lines.

Figure 5:
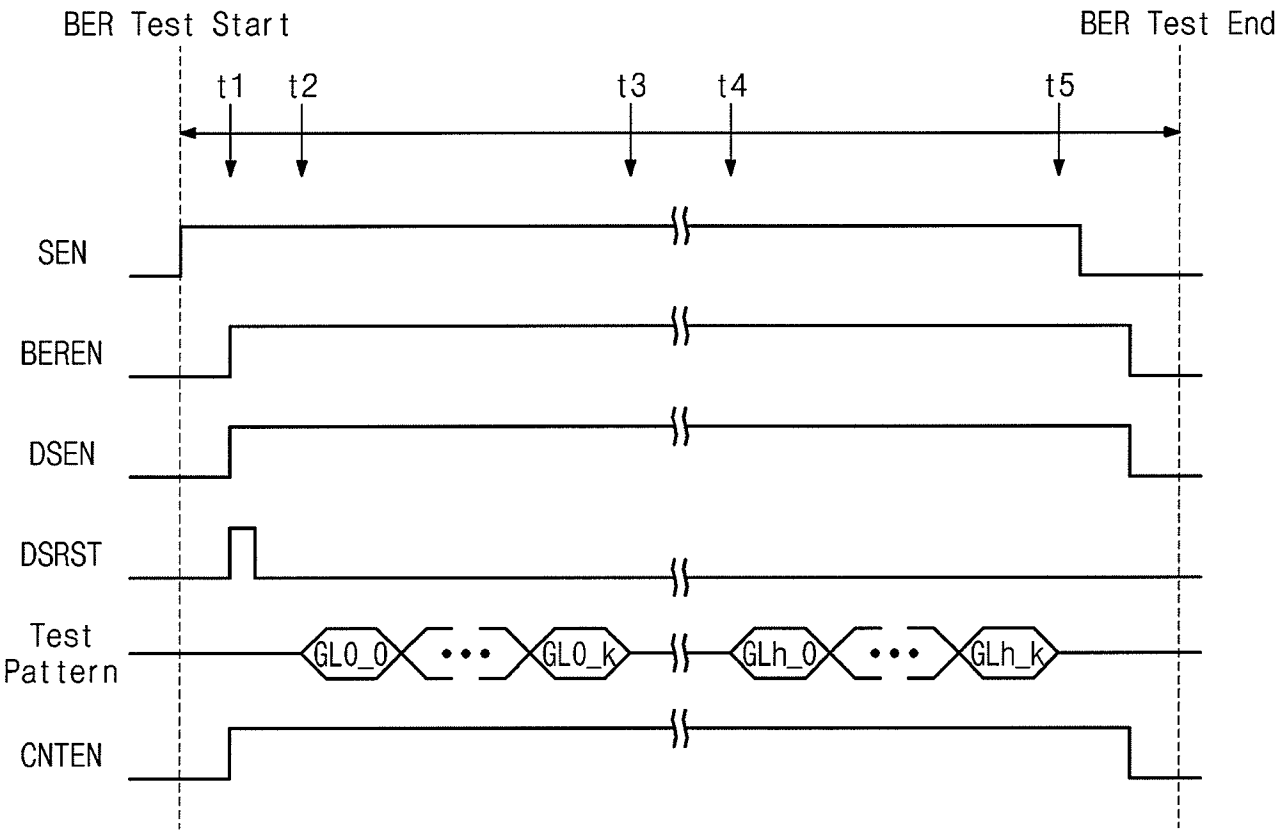
FIG. 5 illustrates a timing diagram of a control signal and data transferred at execution of bit error rate test according to an example embodiment.

FIG. 5 illustrates a timing diagram of a control signal and data transferred at execution of bit error rate test according to an example embodiment.

When a timing controller 130 (refer to FIG. 3) operates in the bit error rate (BER) test mode, the scrambler 134 may be activated in response to a scrambler signal SEN, and data transfer for executing the BET test may be started. If the scrambler 134 is activated, a pseudo random binary sequence (PRBS) test pattern, similar to real data, may be transferred.

If the activated BER test start signal BEREN is transferred to the source driver 170 (refer to FIG. 3) from the timing controller 130 at t1, the source driver 170 may operate in the BER test mode. The source driver 170 may operate in the BER test mode when an inactivated BER test start signal BEREN is transferred.

If an activated de-scrambler signal DSEN is transferred at t1, the de-scrambler 172 of the source driver 170 may de-randomize (or, de-scramble) transferred data. The de-scrambler 172 may continue to operate until an inactivated de-scrambler signal DSEN is transferred. The de-scrambler 172 may be reset by the de-scrambler reset signal DSRST. The error counter 174 may be activated in response to a count signal CNTEN.

If a condition for executing a BER test operation is configured, at t2, the test pattern may be transferred. Each test pattern transferred when the BER test operation is performed may have a size corresponding to the number of pixels connected with a gate line GL. For example, first, during a period t2 to t3, there may be transferred a test pattern to be provided to pixels connected with the first gate line GL0. A test pattern to be provided to pixels connected with a next gate line may be continuously transferred. Finally, during a period t4 to t5, a test pattern to be provided to pixels connected with a last gate line GLk may be transferred. During a period t2 to t5, the error counter 174 may count errors of the transferred test patterns.

If all test patterns are transferred, at t5, the scrambler 134 of the timing controller 130 may be inactivated. Further, the inactivated BER test start signal BEREN and an inactivated de-scrambler signal DSEN may be sent to the source driver 170 from the timing controller 130. As a result, data transfer for the BER test may be completed.

In FIG. 5, exemplarily, a test pattern having a size corresponding to one frame (from a first gate line to a last gate line) may be transferred. The size of a test pattern for the BER test may be changed according to a test circumstance, a test method, etc. Further, the test pattern may be formed of a combination of data suitable for error measurement.

Figure 6:
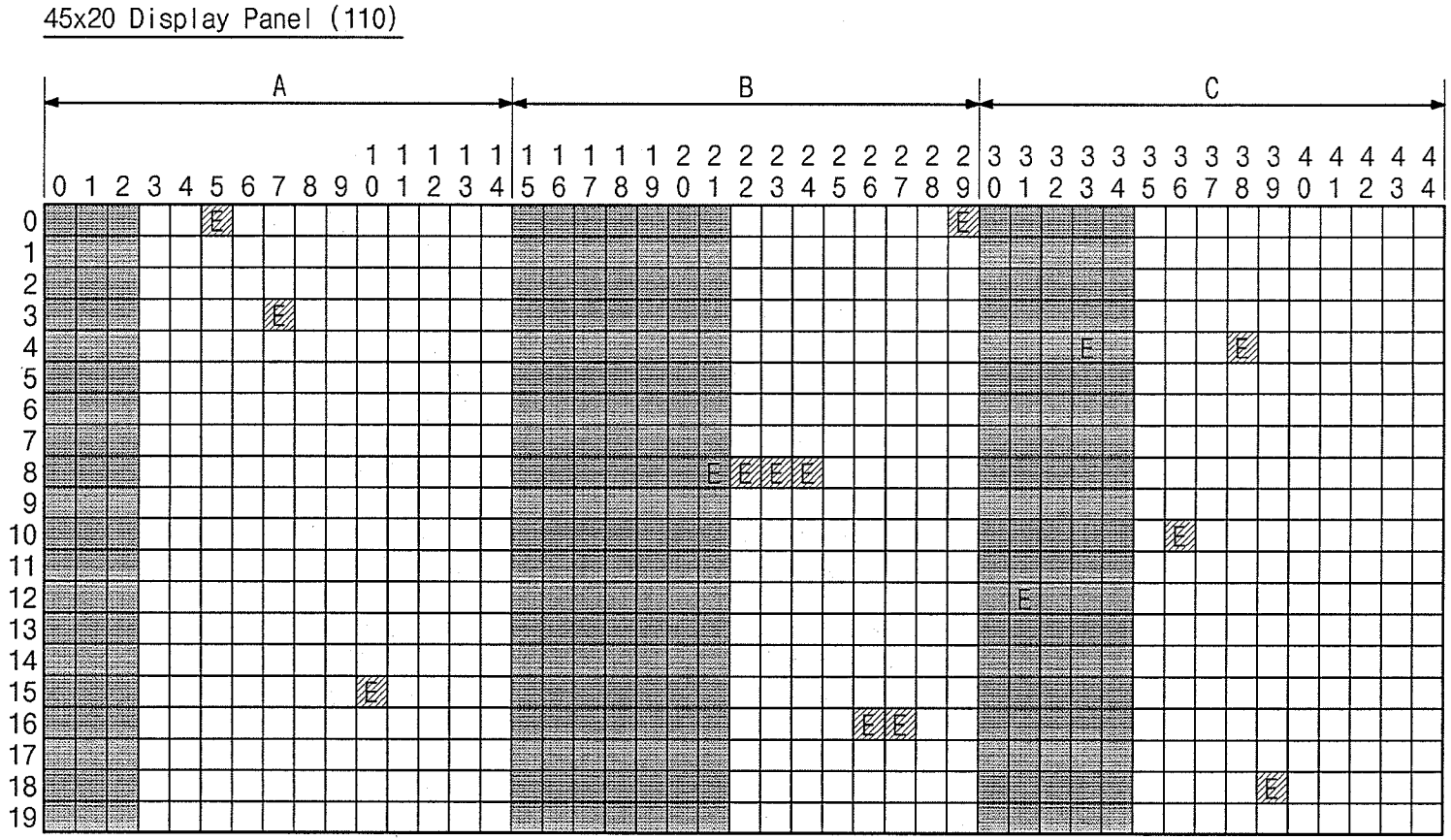
FIG. 6 illustrates a diagram of a test result after bit error rate test is performed.

FIG. 6 illustrates a diagram of a test result after bit error rate test is performed.

An erroneous bit number counted by the error counter 174 of the source driver 170 (refer to FIG. 3) may be output to an external device or to the display panel 110, as the BER test result. In FIG. 6, a method of outputting the BER test result to the display panel 110 is exemplarily shown. In FIG. 6, it is assumed that the display panel 110 has a 45×20 resolution.

Regions A, B, and C of the display panel 110 may be driven by source drivers 170_*a*, 170_*b*, and 170_*c* (refer to FIG. 1), respectively. Each of the source drivers 170_*a*, 170_*b*, and 170_*c* may count erroneous bits in a BER test pattern transferred from the timing controller 130 (refer to FIG. 1). An erroneous bit number counted by each of the source drivers 170_*a*, 170_*b*, and 170_*c* may be accumulated until the BER test is ended. The accumulated erroneous bit number may be output via a column line of the display panel 110. The column line of the display panel 110 may refer to pixels connected with one source line SL.

Referring to FIG. 6, for example, the source driver 170_a may count three erroneous bits E with respect to a transferred BER test pattern, and may control pixels connected with three column lines (i.e., source lines SL0 to SL2) to display any color. The source driver 170_*b* may count seven erroneous bits E with respect to a transferred BER test pattern, and may control pixels connected with seven column lines (i.e., source lines SL15 to SL21) to display any color. The source driver 170_*c* may count five erroneous bits E with respect to a transferred BER test pattern, and may control pixels connected with five column lines (i.e., source lines SL30 to SL34) to display any color.

In FIG. 6, there is exemplarily shown the case that the BER test result is output to the display panel 110. In other implementations, the BER test result may be output by various methods via the display panel 110. Further, the BER test result may be stored in a source driver 170. The BER test result stored in the source driver 170 may be output to the exterior from the source driver 170 as occasion demands. For example, the BER test result stored in the source driver 170 may be output via a data port connected with the source driver 170.

Figure 7:
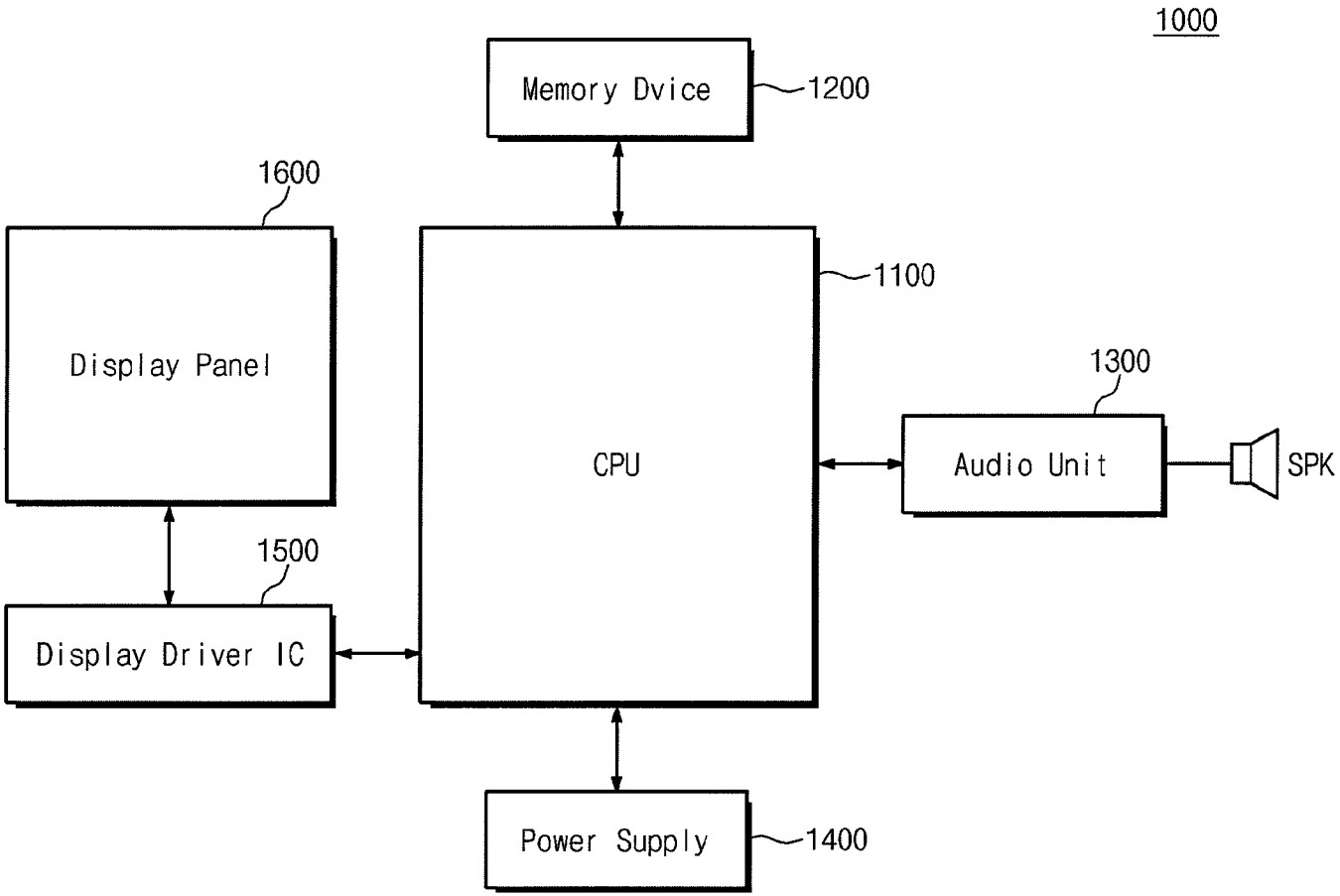
FIG. 7 illustrates a block diagram of a user device including a display driver circuit according to an example embodiment.

FIG. 7 illustrates a block diagram of a user device including a display driver circuit according to an example embodiment. Referring to FIG. 7, a user device 1000 may be an electronic device which is configured to display an image via a display panel 1600, for example. The user device 1000 may include a CPU 1100, a memory device 1200, an audio unit 1300, a power supply 1400, a display driver circuit 1500, and a display panel 1600.

The CPU 1100 may control an overall operation of the user device 1000. For example, the CPU 1100 may control a booting procedure of the user device 1000 when the user device 1000 is powered. Further, the CPU 1100 may activate each element according to setting of a user. The CPU 1100 may be configured to drive firmware for controlling the user device 1000. The firmware may be loaded and driven on a working memory of the memory device 1200.

The memory device 1200 may include a nonvolatile memory device such as ROM, a flash memory device, etc. and a volatile memory device such as DRAM. The memory device 1200 may store data necessary to drive the user device 1000. For example, the memory device 1200 may be used to store an operating system for driving the user device 1100, an application program, or firmware. Further, the operating system, the application program, or the firmware may be loaded on a volatile memory device included in the memory device 1200 under the control of the CPU 1100.

The audio unit 1300 may include a speaker SPK. The audio unit 1300 may replay audio data under the control of the CPU 1100. The power supply 1400 may supply a power necessary to drive the user device 1000. If the user device 1000 is a handheld device such as a mobile electronic device, the power supply 1400 may be formed of a small-sized power supply such as a battery.

The display driver IC 1500 may receive an image signal from the CPU 1100. The display driver IC 1500 may generate color data using the input image signal to provide it to the display panel 1600. The display panel 1600 may display input image data.

According to an example embodiment, the display driver IC 1500 may be configured to make a BER test independently. Thus, a timing controller and a source driver in the display driver IC 1500 may perform a BER test operation for judging whether data transferred via a channel is transferred normally within a given error range. The display driver IC 1500 may display a BER test result via the display panel 1600. In another implementation, a BER test result stored in the display driver IC 1500 may be output to an external device as occasion demands. Since the BER test is made independently by the display driver IC 1500, a test device and a test circumstance for testing a bit error rate may not be required. Accordingly, it may be possible to reduce a cost and a time which are wasted to perform the BER test operation.

Although not shown in figures, the user device 1000 may further include an input part for receiving a control signal of a user, a RF part for transmitting and receiving a voice signal, a picture signal, and various data, etc.

By way of summation and review, large and clear images may be displayed via a large and high-resolution display panel. In the case of the large display panel, the control signal and the color data provided to the display panel may be transferred via long transfer lines, such that errors may arise due to signal delay or electromagnetic interference (EMI). Bit error rate testing may be made to test whether the control signal and the color data provided to the display panel are normally transferred within an allowable limit of error.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A display driver circuit, comprising:

a source driver configured to drive source lines of a display panel; and a timing controller configured to transfer image data to the source driver and to control the source driver such that the transferred image data is displayed via the display panel, the timing controller also being configured to transfer to the source driver a control signal and a test pattern, which are used to test a bit error rate of a channel between the timing controller and the source driver, and the source driver being configured to test the bit error rate of the transferred test pattern in response to the transferred control signal, the test of the bit error rate producing a result indicative of whether the image data transferred from the timing controller to the source driver is within a predetermined limit of error, the error based on signal delay or electromagnetic interference in the channel between the timing controller and source driver, wherein the timing controller includes a pattern generator configured to generate the test pattern, wherein the test pattern is randomized by a scrambler, and wherein the transferred test pattern is de-randomized by a de-scrambler, wherein the test pattern is a pseudo random binary sequence signal to be transferred after configuration signals configuring the test of the bit error rate and before wait signals indicating a transfer wait time, wherein the configuration signals are transferred to the source driver after a start of line signal SOL indicating data corresponding to a gate line, have a BER test start signal BEREN, a de-scrambler signal DSEN, and a de-scrambler reset signal DSRST, and wherein the transferred test pattern subject to the bit error rate test has a size corresponding to a number of pixels connected to a gate line.

2. The display driver circuit as claimed in claim 1, wherein the timing controller includes the scrambler configured to randomize the test pattern, the scrambler randomizing the image data.

3. The display driver circuit as claimed in claim 1, wherein the source driver includes a de-scrambler configured to de-randomize the transferred test pattern and image data.

4. The display driver circuit as claimed in claim 1, wherein the source driver includes an error counter configured to detect a number of erroneous bits of the test pattern.

5. The display driver circuit as claimed in claim 1, wherein the source driver is configured to output a bit error rate test result via the display panel.

6. The display driver circuit as claimed in claim 1, wherein the source driver is configured to output a bit error rate test result via a data port.

7. The display driver circuit as claimed in claim 1, further comprising:

a gate driver configured to drive gate lines of the display panel.

8. A user device, comprising:

a display panel;

a display driver circuit to drive the display panel, the display driver circuit including:

a source driver to drive source lines of a display panel; and a timing controller to transfer image data to the source driver and to control the source driver such that the transferred image data is displayed via the display panel, the timing controller to transfer to the source driver, in response to a control of a processor, a control signal and a test pattern, which are used to test a bit error rate of a channel between the timing controller and the source driver, and the source driver to test the bit error rate of the transferred test pattern in response to the transferred control signal, wherein:

the processor is to control the display driver circuit such that an image is displayed via the display panel, wherein the test of the bit error rate produces a result indicative of whether the image data transferred from the timing controller to the source driver is within predetermined limit of error, the error based on signal delay or electromagnetic interference in the channel between the timing controller and source driver, wherein the timing controller includes a pattern generator to generate the test pattern, wherein the test pattern is randomized by a scrambler, wherein the transferred test pattern is de-randomized by a de-scrambler, wherein the test pattern is a pseudo random binary sequence signal to be transferred after configuration signals configuring the test of the bit error rate and before wait signals indicating a transfer wait time, wherein the configuration signals are transferred to the source driver after a start of line signal SOL indicating data corresponding to a gate line, have a BER test start signal BEREN, a de-scrambler signal DSEN, and a de-scrambler reset signal DSRST, and wherein the transferred test pattern subject to the bit error rate test has a size corresponding to a number of pixels connected to a gate line.

9. A display device, comprising:

a display panel including a plurality of pixels;

source and gate lines coupled to the pixels;

a display driver including a timing controller and a source driver that has an error counter, the display driver being coupled to the source and gate lines, the display driver to perform a bit error rate test, wherein, during the bit error rate test, the timing controller is to generate a test pattern and transfer the test pattern to the source driver, and the error counter is to count erroneous bits in the test pattern received by the source driver, wherein the timing controller includes a pattern generator to generate the test pattern, wherein the test pattern is randomized by a scrambler, and wherein the transferred test pattern is de- randomized by a de-scrambler, wherein the test pattern is a pseudo random binary sequence signal to be transferred after configuration signals configuring the test of the bit error rate and before wait signals indicating a transfer wait time, wherein the configuration signals are transferred to the source driver after a start of line signal SOL indicating data corresponding to a gate line, have a BER test start signal BEREN, a de-scrambler signal DSEN, and a de-scrambler reset signal DSRST, wherein the transferred test pattern subject to the bit error rate test has a size corresponding to a number of pixels connected to a gate line, and wherein the test of the bit error rate produces a result indicative of whether the image data transferred from the timing controller to the source driver is within predetermined limit of error, the error based on signal delay or electromagnetic interference in a channel between the timing controller and source driver.

10. The display device as claimed in claim 9, wherein the display driver includes a plurality of source drivers, each source driver receiving a corresponding test pattern from the timing controller.

11. The display device as claimed in claim 10, wherein each source driver counts erroneous bits of the corresponding test pattern.

12. The display device as claimed in claim 11, wherein each source driver counts erroneous bits corresponding to a unique subset of columns of the display panel.

* * * * *